United States Patent [19]

Renholt

[11] 3,971,096

[45] July 27, 1976

[54] VACUUM CLEANER, OPERATED BY COMPRESSED AIR

[75] Inventor: Arnkjell Renholt, Sandefjord, Norway

[73] Assignee: A/S Norclean, Sandefjord, Norway

[22] Filed: May 23, 1974

[21] Appl. No.: 472,822

[30] Foreign Application Priority Data

May 25, 1973 Norway ..... 2154/73

[52] U.S. Cl. ..... 15/326; 15/353; 15/409

[51] Int. Cl.² ..... A47L 9/00; A47L 5/18

[58] Field of Search ..... 15/326, 353, 409

[56] References Cited

UNITED STATES PATENTS

| | | | |
|---|---|---|---|
| 1,817,337 | 8/1931 | Baker | 15/409 X |
| 2,191,717 | 2/1940 | Jeffery | 15/409 X |
| 2,863,525 | 12/1958 | Lucian | 15/409 X |
| 2,937,802 | 5/1960 | Fisher | 15/409 X |

FOREIGN PATENTS OR APPLICATIONS

| | | | |
|---|---|---|---|
| 1,110,904 | 4/1968 | United Kingdom | 15/409 |
| 937,312 | 9/1963 | United Kingdom | 15/353 |

*Primary Examiner*—Leonard D. Christian
*Assistant Examiner*—C. K. Moore
*Attorney, Agent, or Firm*—Watson, Cole, Grindle & Watson

[57] ABSTRACT

The present invention relates to a pressurized air-driven suction device for dust, mud, liquids, and similar substances, comprising one or more nozzles for ejecting pressurized air, and including appurtenant venturi tubes situated in an elongated tubular ejector housing, which at its outer end, if desired, may be provided with a silencer. A suction air pipe for supplying suction air is also mounted in said ejector housing, which is itself mounted through the end plate of a container, such as an oil drum having plug holes.

6 Claims, 2 Drawing Figures

VACUUM CLEANER, OPERATED BY COMPRESSED AIR

A series of types of compressed air-driven suction devices, most often termed ejector vacuum cleaners, is previously known and intended for use in strongly contaminated localities as for instance in process plants, shipyards, engine rooms etc. Vacuum cleaners are usually driven by electricity, with resulting heavy weight and complicated equipment necessary produce the suction effect. In cases where a particular strong suction effect has been needed, it has also been suggested, as indicated above, to use pressurized air-driven ejector vacuum cleaners for the purpose, cf. for instance German Auslegeschrift No. 1.013.842, Swedish Pat. No. 112.674 and Norwegian Pat. No. 111.938.

Norwegian Pat. No. 111.938 pertains to a simplified, compact and thereby cheap device having a great suction effect, where all the parts which are necessary to the suction function, with the exception of the container itself, are carried by a lid plate. The pressurized air-driven ejector or ejectors being used (with pressurized air supply and venturi tube) are arranged axially within, and in direct connection to, an open ended ejector tube which is positioned centrally on the lid plate. An inlet pipe for the suction air, is also carried by the lid plate. The inlet of the inlet pipe is directed tangentially relative to the circumference of the lid plate, as is known to the art. The outlet end of the inlet pipe is on the same side of the lid plate as the inlet opening to the open ended ejector tube, but at a substantially less distance from the lid plate than the inlet opening of the open ended ejector tube.

For such embodiment of the pressurized air-driven vacuum cleaner, a separate lid plate is necessary, and if for instance easily available container units, such as empty oil drums are to be used, one of the end faces of the container drum must be removed or provided with one or more openings for the ejector unit with the open ended tube and the suction air pipe, respectively.

In order to use such empty oil drums without perforating one of the end faces and use of the aforementioned lid plate on which all the parts which are necessary for the suction function are arranged, it has been suggested to use the great plug hole of the oil drum for the introduction of the elongated open ended ejector tube which contains the pressurized air-nozzle or nozzles with appurtenant venturi tubes, and to use the small plug hole for the introduction of the suction pipe for the admittance of the suction air into the drum.

However, the available cross section areas are not favorable, and such device would also be more complicated and unsatisfactory with respect to its structure, operating reliability, effectiveness and production costs.

Thus, the present invention pertains to a simplified, sturdy, compact and inexpensive solution to the problem which has existed in this respect.

Thus, the present invention relates to a pressurized air-driven suction device for dust, mud, liquids and similar substances, comprising one or more nozzles, for ejecting pressurized air, and including appurtenant venturi tubes situated in an elongated tubular ejector housing, which at its outer end, if desired, may be provided with a silencer. A suction air pipe for supplying suction air, is mounted through the end plate of a container, preferably an oil drum having plug holes.

The invention resides in the fact that the tubular ejector housing in the area adjacent the end plate also functions as separate passage for the suction air pipe. The inlet and outlet from the suction air pipe are respectively arranged outside and inside the passage area of the tubular ejector housing and in a way so that the outlet from the suction air pipe, or any other parts of the device, will not extend radially beyond the portion of the tubular ejector housing which is adapted to be passed through a corresponding opening in the end plate.

The tubular ejector housing may advantageously be provided with a threaded portion, in the area at the passage near end plate, for being screwed into the great plug hole of a standard oil drum.

The suction air pipe which is passed through the tubular ejector housing may advantageously be arranged as a 180° pipe bend or as a straight pipe.

The tubular ejector housing may further advantageously be provided with a closing device of the float type.

Figure 1:
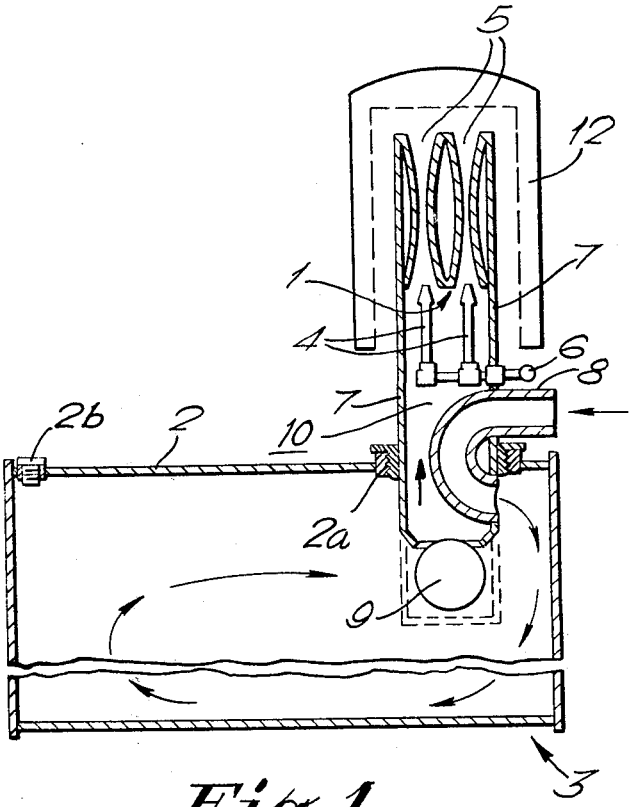
FIG. 1 is a sectional view showing the ejector device in place in the great plug hole of an oil drum. Also shown is the embodiment employing the 180° bend suction inlet passage.

The invention shall in the following be described more in detail, with reference to the attached drawing, which schematically shows a cross section through the two usual plug holes of a standard oil drum having a container portion 3, an end plate 2, with the great and the small plug hole, 22,26 respectively. A tubular ejector housing or enclosure 7 surrounds one or more pressurized air-driven ejector nozzles 4,5 and appurtenant fitting facilities 6 for the supply of pressurized air. The drawing shows the suction air pipe 8 for the introduction of the suction air, in the form of a separate channel without communication with the remaining cross section area of the tubular ejector housing 7. In the illustrated embodiment the tubular ejector housing 7 is, in the area of the passage through the end plate 2, provided with a threaded portion for being screwed into the great plug hole. However, such threaded portion is not absolutely necessary, as said portion may be arranged as a collar (without threads) on the tubular ejector housing 7 and may then in a simple way be held securely to the container lid by a snap lock or similar device or by the influence of the vacuum, when the device is operated.

The device may advantageously be provided with a closing means which automatically closes when the surface of the liquid in the container 3 reaches a certain level, for instance begins to approach the lower or inner end of the tubular ejector housing 7. Such closing device may advantageously be a simple float body of a lightweight material, shown in the form of a spherical float body enclosed in a perforated elongation of the tubular ejector housing 7. Under usual circumstances of operation the float 9 is kept away from the inlet to the elongated enclosure by means of its own weight, but separate means to ensure that the float 9 does not move to closing position before the container is nearly filled with liquid or mud, may of course be arranged.

In the present type of pressurized air-driven vacuum cleaners a muffler or silencer means may often be desirable, and the drawing shows such an optional silencer 12 arranged over the outlet of the venturi tubes 5 and the tubular ejector housing 7. The silencing may be achieved by means of a labyrinthian passage or as illustrated in FIG. 1 by using a silencing material, for example mineral fibre, along the inside walls of silencer 12.

The device according to the invention may easily be manufactured by welding one or more venturi tubes 5 centrally into a tubular ejector housing 7. A nozzle 4 and connection 6 for pressurized air are mounted upstream of the venturi tubes 5 in the tubular ejector housing 7. There is a free passage 10 between the wall of the tubular ejector housing 7 and the nozzle or nozzles 4.

Figure 2:
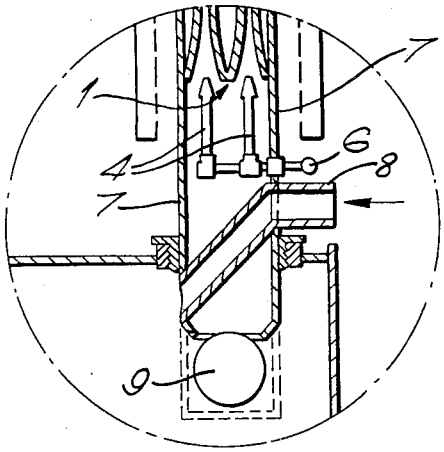
FIG. 2 is a partial sectional view showing a second embodiment of the device using a straight pipe suction inlet passage.

A 180° pipe bend, as shown in FIG. 1 or a straight pipe, as shown in FIG. 2, is welded through the side wall of the tubular ejector housing, the pipe bend having a smaller outer diameter than the inner diameter of the tubular ejector housing. Thereby free passage 10 between the tubular ejector housing and the pipe bend or the straight pipe, past the nozzle and to the venturi tube, is achieved.

The pipe 8 forms a passage into and out of the side wall of the tubular ejector housing 7. The upper end of the pipe 8 has welded thereto a pipe union arranged at a right angle to the longitudinal axis of the tubular ejector housing for the connection of a suction hose.

Between the inlet and outlet of the bend or the straight pipe in the wall of the tubular ejector housing in the area of the passage through the end plate 2, a threaded portion is shown, said portion corresponding to the threads of the great plug hole in a standard oil drum. As mentioned previously, such threaded portion is not absolutely necessary, as the portion may be constituted by a non-thread collar for simple introduction into the plug hole. The device may in a simple way be inserted into or screwed into the drum in the same way as an ordinary drum plug.

In the lower end of the tubular ejector housing, i.e. the end which is screwed down into or simply inserted into the drum, a float valve 9, which may float upwardly and shut off the end of the tubular ejector housing when the drum has been filled with liquid, is arranged. In the illustrated embodiment the end is perforated, but it may also be arranged in the form of a reticulated enclosure around the used buoyant body or float.

The portion of the tubular ejector housing which protrudes upwards from the drum is enclosed by a silencer 12. The silencer 12 is constructed as an outer tubular cup with a tight top portion and is lined with a sound absorbing substance. The exhaust air from the ejector passes between the tubular ejector housing 7 and the sound absorbing substance before the exhaust air is passed to the atmosphere.

Pressurized air is supplied to the pipe union 6 and is passed through the ejector unit (nozzle and venturi tube). The ejector unit will evacuate the air in the drum through the lower end of the tubular ejector housing 7 and thereby create a vacuum in the drum.

Through the pipe bend or the straight suction air pipe 8, a suction air stream will be created, corresponding to the air which the ejector unit evacuates from the drum.

By connection of a suction hose to the outer end of the suction air pipe 8, solid and liquid substances may be drawn (sucked) into the drum.

To avoid an over-filling of liquid in the drum, the float 9 will float upwards and shut off the stream of suction air through the lower end of the tubular ejector housing 7.

I claim:

1. A pressurized air-operated vacuum cleaner apparatus having an ejector device with nozzle means and appurtenant venturi means for creating a vacuum in an oil drum type container, said ejector device including an inlet passage for conducting suction air and entrained debris from a location outside said container into said container and an outlet passage for conducting air from said container, said nozzle means being mounted in said outlet passage upstream from said venturi means, means for supplying high pressure operating air to said nozzle means for ejection thereof downstream into said venturi means to produce said vacuum, said container including an open plug hole and a closed plug hole, the improvement comprising, an elongated housing enclosing said ejector device and being mounted with a sealing fit through said open plug hole, said elongated housing including a first opening in a first end portion thereof extending into said container and a second opening at a second end portion thereof extending outwardly of said container, said elongated housing further including a third opening adjacent said first opening and a fourth opening in a side wall of said elongated housing outside of said container, said outlet passage extending between said first and second openings and said inlet passage extending between said third and fourth openings.

2. Apparatus as in claim 1 further comprising a muffler mounted over said second opening of said elongated housing.

3. Apparatus as in claim 1 wherein said open plug hole includes threads and said elongated housing includes a threaded portion for sealingly engaging said threads.

4. Apparatus as in claim 1 wherein said third and fourth openings are in the same wall of said elongated housing and said inlet passage is in the form of a 180° pipe bend.

5. Apparatus as in claim 1 wherein said third and fourth openings are opposite one another and said inlet passage is in the form of a straight pipe.

6. Apparatus as in claim 1 further comprising means for sealing said first opening when a specified level of debris within said container is reached.

* * * * *